US009361903B2

(12) United States Patent
Leorin et al.

(10) Patent No.: US 9,361,903 B2
(45) Date of Patent: Jun. 7, 2016

(54) PRESERVING PRIVACY OF A CONVERSATION FROM SURROUNDING ENVIRONMENT USING A COUNTER SIGNAL

(71) Applicant: Microsoft Technology Licensing, LLC, Redmond, WA (US)

(72) Inventors: Simone Leorin, Redmond, WA (US); Nghiep Duy Duong, Sammamish, WA (US); Steven Wei Shaw, Bellevue, WA (US); William George Verthein, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 303 days.

(21) Appl. No.: 13/973,414

(22) Filed: Aug. 22, 2013

(65) Prior Publication Data

US 2015/0057999 A1 Feb. 26, 2015

(51) Int. Cl.

| | |
|---|---|
| ***G10L 21/0208*** | (2013.01) |
| ***G10L 25/03*** | (2013.01) |
| ***H04K 3/00*** | (2006.01) |

(Continued)

(52) U.S. Cl.

CPC ..... *G10L 21/0272* (2013.01); *G10K 11/175* (2013.01); *H04K 3/41* (2013.01); *H04K 3/45* (2013.01); *H04K 3/825* (2013.01); *G10K 2210/1081* (2013.01); *G10K 2210/12* (2013.01); *G10K 2210/3011* (2013.01); *G10K 2210/3046* (2013.01); *G10L 21/0208* (2013.01); *G10L 25/03* (2013.01); *H04K 2203/12* (2013.01); *H04K 2203/34* (2013.01)

(58) Field of Classification Search

CPC ..... G10L 21/0208; G10L 2021/02087; G10L 21/16; G10L 25/03; G10K 11/002; H04K 3/41; H04K 3/45

USPC ..... 704/205, 211, 226, 277; 381/71.8

See application file for complete search history.

(56) References Cited

U.S. PATENT DOCUMENTS

| | | | |
|---|---|---|---|
| 6,690,800 | B2 | 2/2004 | Resnick |
| 7,088,828 | B1 | 8/2006 | Bradford et al. |

(Continued)

FOREIGN PATENT DOCUMENTS

| | | |
|---|---|---|
| JP | 2006166300 | 6/2006 |
| JP | 2012098632 | 5/2012 |

OTHER PUBLICATIONS

Yamamoto, et al., "Privacy Protection for Speech Information", Retrieved at <<http://ieeexplore.ieee.org/stamp/stamp.jsp?tp=&arnumber=5283279>> in Fifth International Conference on Information Assurance and Security, vol. 1, Aug. 18, 2009, pp. 4.

(Continued)

*Primary Examiner* — James Wozniak

(74) *Attorney, Agent, or Firm* — Danielle Johnston-Holmes; Micky Minhas

(57) ABSTRACT

Various embodiments provide an ability to analyze an audio input signal and generate a counter audio signal based, at least in part, on the audio input signal. In some cases, combining the audio input signal with the counter audio signal renders the audio input signal incoherent and/or unintelligible to accidental listeners and/or listeners to whom the audio input signal is not directed towards. Alternately or additionally, the counter signal can mask the audio input signal to the accidental listeners.

20 Claims, 6 Drawing Sheets

(51) Int. Cl.
*G10L 21/0272* (2013.01)
*G10K 11/175* (2006.01)

(56) References Cited

U.S. PATENT DOCUMENTS

| | | | | |
|---|---|---|---|---|
| 8,059,828 | B2 | 11/2011 | Ho et al. | |
| 8,170,229 | B2 | 5/2012 | Kesterson | |
| 8,606,573 | B2 * | 12/2013 | Konchitsky | 704/233 |
| 8,824,666 | B2 * | 9/2014 | Conte et al. | 379/406.02 |
| 2004/0125922 | A1 | 7/2004 | Specht | |
| 2004/0192243 | A1 * | 9/2004 | Siegel | 455/296 |
| 2006/0184362 | A1 * | 8/2006 | Preuss | G10L 15/20 704/233 |
| 2006/0241939 | A1 * | 10/2006 | Hillis et al. | 704/213 |
| 2006/0247919 | A1 | 11/2006 | Specht et al. | |
| 2007/0055513 | A1 * | 3/2007 | Hwang et al. | 704/233 |
| 2007/0083361 | A1 * | 4/2007 | Ferencz et al. | 704/201 |
| 2008/0118081 | A1 * | 5/2008 | Chang | 381/94.1 |
| 2008/0235008 | A1 * | 9/2008 | Ito et al. | 704/216 |
| 2009/0060216 | A1 * | 3/2009 | Sweeney et al. | 381/71.2 |
| 2009/0061882 | A1 * | 3/2009 | Sweeney et al. | 455/445 |
| 2009/0171670 | A1 | 7/2009 | Bailey et al. | |
| 2009/0323925 | A1 * | 12/2009 | Sweeney et al. | 379/406.05 |
| 2011/0263233 | A1 * | 10/2011 | Mikan et al. | 455/414.1 |
| 2012/0269203 | A1 * | 10/2012 | Higa | G10L 21/0272 370/480 |
| 2012/0316869 | A1 | 12/2012 | Xiang et al. | |
| 2012/0328123 | A1 * | 12/2012 | Fukui | G10L 21/0388 381/98 |
| 2013/0185061 | A1 | 7/2013 | Arvanaghi et al. | |
| 2013/0259254 | A1 * | 10/2013 | Xiang et al. | 381/73.1 |
| 2014/0003596 | A1 * | 1/2014 | Arenburg et al. | 379/201.11 |
| 2015/0039288 | A1 * | 2/2015 | Pedre | 704/3 |
| 2015/0199954 | A1 * | 7/2015 | Ukai | G10K 11/175 381/73.1 |

OTHER PUBLICATIONS

Cheng, et al., "A Collaborative Privacy-Enhanced Alibi Phone", Retrieved at <<http://www.petercllin.com/publication/alibi.pdf>> in Proceedings of the First International Conference on Advances in Grid and Pervasive Computing, May 3, 2006, pp. 6.

"The Boom Noise Canceling Headset", Retrieved at <<http://www.thetravelinsider.info/roadwarriorcontent/boomheadset.htm Feb. 16, 2004, pp. 4.

"International Search Report and Written Opinion", Application No. PCT/US2014/051571, Feb. 12, 2015, 13 Pages.

"Second Written Opinion", Application No. PCT/US2014/051571, Jul. 14, 2015, 9 pages.

"International Preliminary Report on Patentability", Application No. PCT/US2014/051571, Dec. 15, 2015, 11 pages.

* cited by examiner

PRESERVING PRIVACY OF A CONVERSATION FROM SURROUNDING ENVIRONMENT USING A COUNTER SIGNAL

BACKGROUND

The advancement of portable devices has enabled users to access functionality traditionally found in an office setting at alternative locations. For example, laptop computers allow a user to move their work from a traditional office environment to a less traditional public location, such as a coffee shop environment. Similarly, a user can conduct a telephone conference from that same coffee shop using a mobile telephone device or the laptop computer. While portable devices give more flexibility to the user, these alternative locations can sometimes detract from that flexibility. For instance, a user conducting a telephone conference in a traditional office environment might be able to converse more freely than when conducting that same telephone conference from a coffee shop. While a traditional office environment gives the user some privacy (e.g. co-workers for a same company, a private office, a closed environment, etc.), the coffee shop may reduce the user's amount of privacy, such as through non-work related persons sitting at a proximity close enough to hear audio associated with telephone conference and/or what is being said.

SUMMARY

This Summary is provided to introduce a selection of concepts in a simplified form that are further described below in the Detailed Description. This Summary is not intended to identify key features or essential features of the claimed subject matter.

Various embodiments provide an ability to analyze an audio input signal and generate a counter audio signal based, at least in part, on the audio input signal. In some cases, combining the audio input signal with the counter audio signal renders the audio input signal incoherent and/or unintelligible to accidental listeners and/or listeners to whom the audio input signal is not directed. Alternately or additionally, the counter signal can mask the audio input signal to the accidental listeners.

BRIEF DESCRIPTION OF THE DRAWINGS

The detailed description references the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

In one or more embodiments, a device is configured analyze an audio input signal and generate a counter signal based, at least in part, on the audio input signal. At times, the counter signal can include an inverse signal of the audio input signal, where the inverse signal is configured to reduce and/or silence the audio input signal to accidental listeners and/or listeners to whom the audio input signal is not directed. For example, audio received via a microphone associated with a communication device can be transmitted to an intended recipient intact, while the counter signal can be transmitted and/or played outwardly towards accidental and/or unintended listeners in close proximity to the communication device. Alternately or additionally, the counter signal can include an acoustic alert configured to inform accidental listeners that an audio cancelling event is in progress, such as a preselected tone. In some cases, the counter signal can include an audio signal associated with a translation of the audio input signal to an alternate language.

In the following discussion, an example environment is first described that may employ the techniques described herein. Example procedures are then described which may be performed in the example environment, as well as other environments. Consequently, performance of the example procedures is not limited to the example environment and the example environment is not limited to performance of the example procedures.

Example Environment

Figure 1:
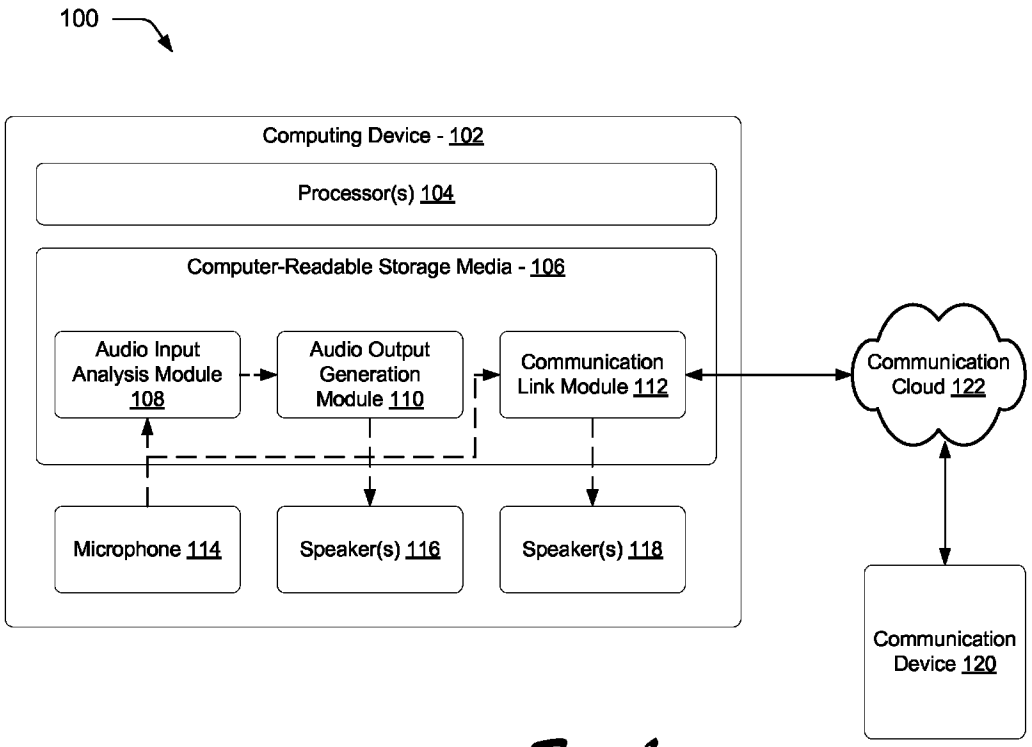
FIG. 1 is an illustration of an environment with an example implementation that is operable to perform the various embodiments described herein.

FIG. 1 illustrates an operating environment in accordance with one or more embodiments, generally at 100. Environment 100 includes computing device 102. In some embodiments, computing device 102 represents any suitable type of communication device, such as a mobile telephone, a computer with Voice-Over-Internet Protocol (VoIP) capabilities, and so forth. Alternately or additionally, computing device 102 represents an accessory to a communication device, such as a headset configured to connect into a communication device and/or computing device. While illustrated as a single device, it is to be appreciated and understood that functionality described with reference to computing device 102 can be implemented using multiple devices without departing from the scope of the claimed subject matter. For simplicity's sake, and not of limitation, the discussion of functionality related to computing device 102 has been shortened to the modules described below.

Among other things, computing device 102 includes processor(s) 104, computer-readable storage media 106, audio input analysis module 108, audio output generation module 110, and communication link module 112 that reside on the computer-readable storage media and are executable by the processor(s). The computer-readable storage media can include, by way of example and not limitation, all forms of volatile and non-volatile memory and/or storage media that are typically associated with a computing device. Such media can include ROM, RAM, flash memory, hard disk, removable media and the like. Alternately or additionally, the functionality provided by the processor(s) 104 and modules 108, 110, 112 can be implemented in other manners such as, by way of example and not limitation, programmable logic and the like.

Audio input analysis module 108 represents functionality configured to analyze an audio input signal. In this illustration, audio input analysis module 108 receives the audio input signal via microphone 114. This can be achieved in any suitable manner. For example, in some embodiments, audio input analysis module 108 receives digitized samples of an analog audio input signal that has been generated by microphone 114 and fed to an Analog-to-Digital Converter (ADC). In other embodiments, audio input analysis module 108 can receive a continuous waveform. Upon receiving the audio input signal, audio input analysis module 108 identifies properties, characteristics, and/or traits of the audio input signal, such as amplitude-versus-time, phase-versus-time, tonal and/or frequency content, and so forth. In some embodiments, input audio analysis module determines and/or identifies word content related to word(s) being spoken in and/or represented by the audio input signal.

Audio output generation module 110 represents functionality that generates a counter audio signal based, at least in part, on the audio input signal. For example, the counter audio signal can be generated as digitized samples that can be used to drive a Digital-to-Analog Converter (DAC) effective to generate an analog signal. Any suitable type of counter audio signal can be generated. In some embodiments, audio output generation module 110 generates an inverse audio signal that is configured to reduce and/or cancel out the audio input signal. In other embodiments, audio output generation module 110 generates a counter audio signal that is representative a language translation of identified word content of audio input signal, as further described below. Alternately or additionally, the counter audio signal can include an acoustic alert, such as a constant tone. Once generated, the counter audio signal can be used as an input to speaker(s) 116, as further described below.

Communication link module 112 generally represents functionality that can maintain a communication link for computing device 102 with other devices. Among other things, communication link module 112 enables communication device 102 to send and receive audio signals to other communication devices, as well perform any protocol and/or handshaking that is utilized to maintain a communication link with the other communication devices. In some embodiments, when audio is received from another communication device, communication link module 112 can direct the received audio to a designated speaker, such as speaker 118. In this example, communication link module 112 is illustrated as sending and receiving communications with communication device 120 through communication cloud 122. When an audio input signal is received via microphone 114, communication link module 112 can send the audio input signal to communication device 120 through communication cloud 122. Conversely, when audio is received from communication device 120, communication link module 112 can route the received audio to speaker 118. While illustrated as a single module, it is to be appreciated and understood that functionality described in relation to communication link module 112 can be implemented as several separate modules without departing from the scope of the claimed subject matter.

Microphone 114 receives an acoustic wave input and converts the acoustic wave into an electronic representation, such as voltage-versus-time representation. Here, microphone 114 is illustrated as providing an audio input signal to audio input analysis module 108 and communication link module 112. As described above and below, audio input analysis module 108 generates the counter audio signal based upon the audio input signal, which is then used to drive speaker(s) 116, while communication link module 112 transmits the audio input signal to an intended recipient at communication device 120.

Speaker(s) 116 and 118 represent functionality that can convert an electronic audio signal to an acoustic wave. In some embodiments, speaker(s) 116 projects an acoustic wave outward from computing device 102 such that multiple people can hear the acoustic wave, while speaker(s) are configured to project an acoustic wave towards a single listener. In some embodiments, speaker(s) 116 can be used to radiate the counter audio signal, such as in a similar fashion to a speaker phone positioned to direct an acoustic wave to multiple listeners. Alternately or additionally, speaker(s) 118 can be configured to project audio received from communication device 120 to a single user of computer device 102, such as through an earpiece speaker facing inward towards a user's ear, an ear plug, and so forth.

Communication device 120 represents a computing device that can maintain a communication link with computing device 102 through communication cloud 122. Communication device 120 can be any suitable type of computing device, such as a personal computer (PC), a laptop, a mobile device, a tablet, and so forth. For example, in some embodiments, communication device 120 can be a computer with VoIP capabilities, a mobile phone, etc., while computing device 102 is a headset coupled to communication device 120 through communication cloud 122, such as through a Bluetooth wireless connection, a hard wire connection, and so forth. In such an embodiment, a user would utilize communication device 120 to establish communication call and/or links with other users and/or recipients, and computing device 102 as a way to generate audio to send to the other users and listen to audio received from the other users (e.g. a headset accessory to communication device 120). In other embodiments, communication device 120 and computing device 102 each represent a communication devices configured to establish a communication call and/or link with one another through a wireless telecommunication network, an Internet connection, and so forth.

Communication cloud generally represents a bi-directional link into and/or out of computing device 102. Any suitable type of communication link can be utilized. For example, as discussed above, communication cloud 122 can be as simple as a hardwire connection between a headset and a computing device. In other embodiments, communication cloud 122 represents a wireless communication link, such as a Bluetooth wireless link, a wireless local area network (WLAN) with Ethernet access and/or WiFi, a wireless telecommunication network, and so forth. Thus, communication cloud 122 represents any suitable link, whether wireless or hardwire, that computing device 102 can use to send and receive data, information, signals, and so forth.

Generally, any of the functions described herein can be implemented using software, firmware, hardware (e.g., fixed logic circuitry), or a combination of these implementations. The terms "module," "functionality," "component" and "logic" as used herein generally represent software, firmware, hardware, or a combination thereof. In the case of a software implementation, the module, functionality, or logic represents program code that performs specified tasks when executed on a processor (e.g., CPU or CPUs). The program code can be stored in one or more computer readable memory devices. The features of the techniques described below are platform-independent, meaning that the techniques may be implemented on a variety of commercial computing platforms having a variety of processors.

Having described an example environment in which the techniques described herein may operate, consider now a discussion of privacy preservation in a shared environment in accordance with one or more embodiments.

Privacy Preservation in a Shared Environment

A person conducting conversations in a shared and/or public environment can run the risk of having the content in their conversations being overheard by unintended listeners. While whispering and/or lowering a person's voice level can make it harder for surrounding (and unintended) listeners to hear a conversation, it can also make it difficult for the intended recipient to hear the conversation, or for the communication device to capture the associated audio. Various embodiments provide an ability to garble, cancel, and/reduce an acoustic waveform as perceived by surrounding and/or unintended recipients.

Figure 2:
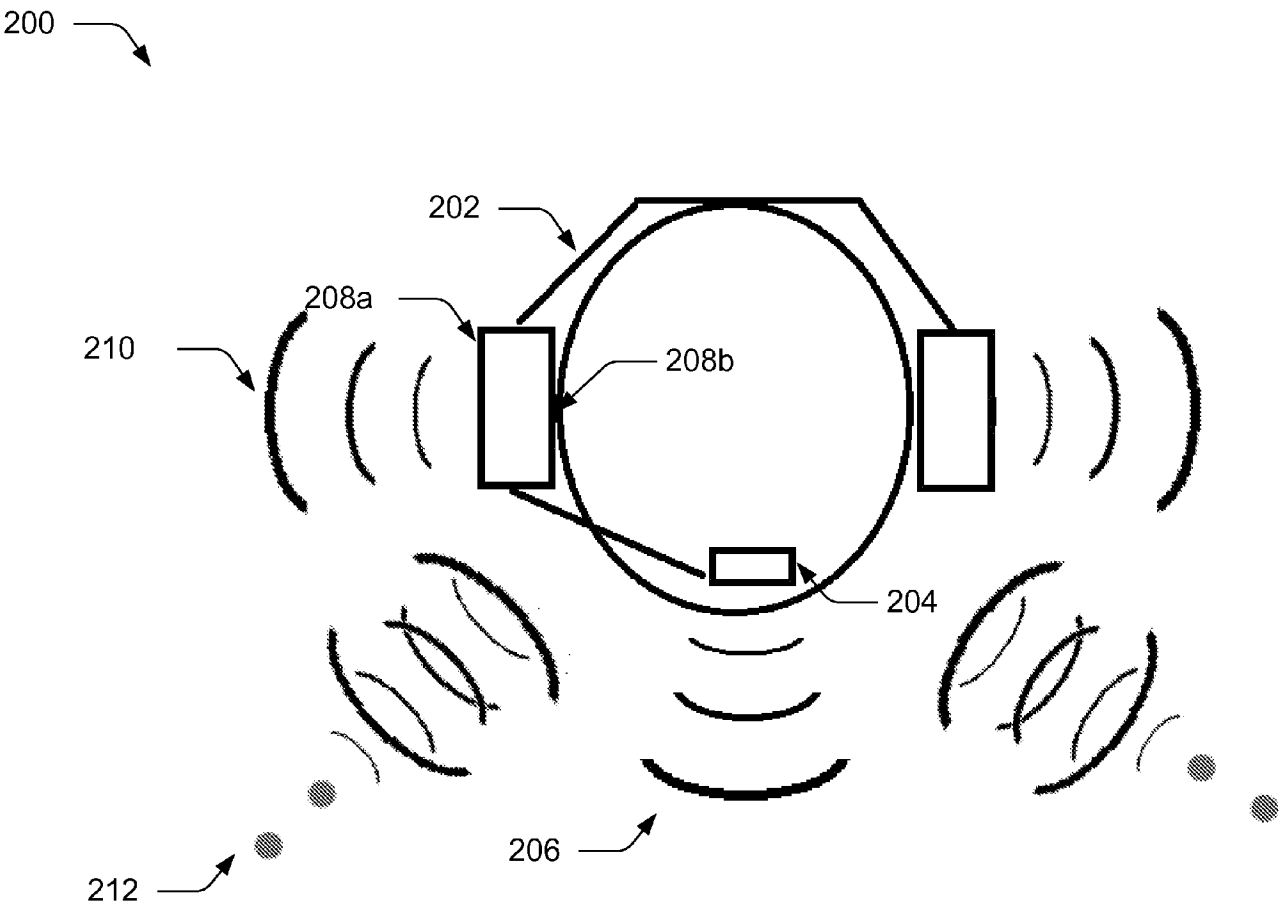
FIG. 2 is an illustration of an environment in an example implementation in accordance with one or more embodiments.

Consider FIG. 2, which illustrates an example environment 200 that includes device 202. Here, device 202 is a headset configured to send and receive audio signals as part of a communication link with other computing devices, similar to computing device 102 described above in FIG. 1. Device 202 can be configured in any suitable manner, such as a standalone headset that includes wireless telecommunication capabilities to directly establish a communication link with another communication device via an associated wireless telecommunication network, a headset configured to be coupled to a second device (such as a computer with VoIP capabilities, a mobile telephone, etc.) that is used to establish a communication link to another user, and so forth. By speaking into microphone 204, a user can capture acoustic waves that are then transmitted to an intended recipient. In this example, acoustic waves 206 are vocally generated by the user. When microphone 204 is placed in the path of the acoustic waves (e.g. the user's mouth), device 202 can capture the acoustic wave with a representation that is accurate enough for an intended recipient user (e.g. a participant in the communication link) to understand what the user is saying. However, while acoustic waves 206 are focused on microphone 204, it can be seen that additional waves radiate outside of the perimeter of device 202, thus enabling unintended users (e.g. users who are not participants in the communication link) to hear the content of acoustic waves 206 generated by the user.

In some embodiments, an audio input signal can be analyzed to determine properties of the signal, such as an audio input signal generated from acoustic waves 206. For instance, the audio input signal can be analyzed for frequency and/or tonal properties, instantaneous voltage-versus-time properties (discrete or continuous), phase-versus-time properties, word content of the audio input signal, and so forth. Once the audio input signal has been analyzed, at least in part, some embodiments generate a counter signal based upon the audio input signal and/or the determined properties. Any suitable type of counter signal can be generated. For instance, in some embodiments, the counter signal can include an inverse audio signal designed to reduce and/or cancel out the audio input signal. Among other things, a sound wave can be described with compression phase properties and/or rarefaction phase properties, where a compression phase property can be used to identify an increase in sound pressure and a rarefaction phase property can be used to identify a decrease in sound pressure. In some cases, an inverse audio signal can be configured as a sound wave with a same amplitude but inverted phase, so that when emitted and/or radiated outward and combined with the audio input signal, the two cancel each other out. Alternately or additionally, the counter signal can include a constant tone designed to alert surrounding listeners that an audio cancellation event is in progress, or an audio signal designed to mask and/or garble the effects of acoustic waves 206 is in progress. At times, the counter signal can include a combination of multiple counter signals, such an inverse audio signal and a constant tone. Thus, in some embodiments, the counter signal is configured to modify audible acoustic effects around and/or in close proximity (e.g. close enough to discern the audio input signal) to device 202.

Once a counter signal has been generated, device 202 plays the resultant counter signal through speaker(s) 208*a* effective to generate acoustic waves 210. Here, speaker(s) 208*a* is directed outward from device 202 and/or towards a surrounding environment (e.g. the earpiece side that faces outward from the user's ear). Conversely, speaker 208*b* is illustrated as the earpiece side that faces inwards and/or towards the user's ear. While speaker(s) 208*a* projects the counter signal outward, speaker 208*b* projects an audio signal to the user that is generated from another user in the communication link. As discussed above, the counter signal is illustrated as radiating out from speaker 208*a* in the form of acoustic waves 210.

Acoustic waves 210 represent the counter signal converted into an acoustic wave. As discussed above, the resultant acoustic wave for the counter signal can include a combination of counter signals. For instance, an acoustic alert can be included as a way to notify the surrounding listeners that an audio cancellation process is in progress. In some embodiments, a user can selectively enable and disable whether an acoustic alert is generated and combined with other signals in the counter signal, such as through the use of an ON/OFF switch. Alternately or additionally, acoustic waves 210 can include a masking audio signal can be any suitable type of signal, such as a language translation of the audio input signal projected at a power level higher than acoustic waves 206, a garbled and/or unintelligible audio signal, and so forth. In this example, acoustic waves 210 include an inverse signal designed to reduce and/or silence acoustic waves 206.

Acoustic waves 212 represent acoustic waves 210 combined with acoustic waves 206. In this example, acoustic waves 212 represents a resultant acoustic wave that has reduced and/or canceled out acoustic waves 206 such that listeners in a region surrounding device 202 are unable to easily discern the content of acoustic waves 206. Thus, by capturing and/or analyzing an audio input signal, a counter signal can be generated that helps obscure and/or mask the audio input signal from unintended recipients which, in turn, can help a user preserve their privacy in a conversation.

Figure 3:
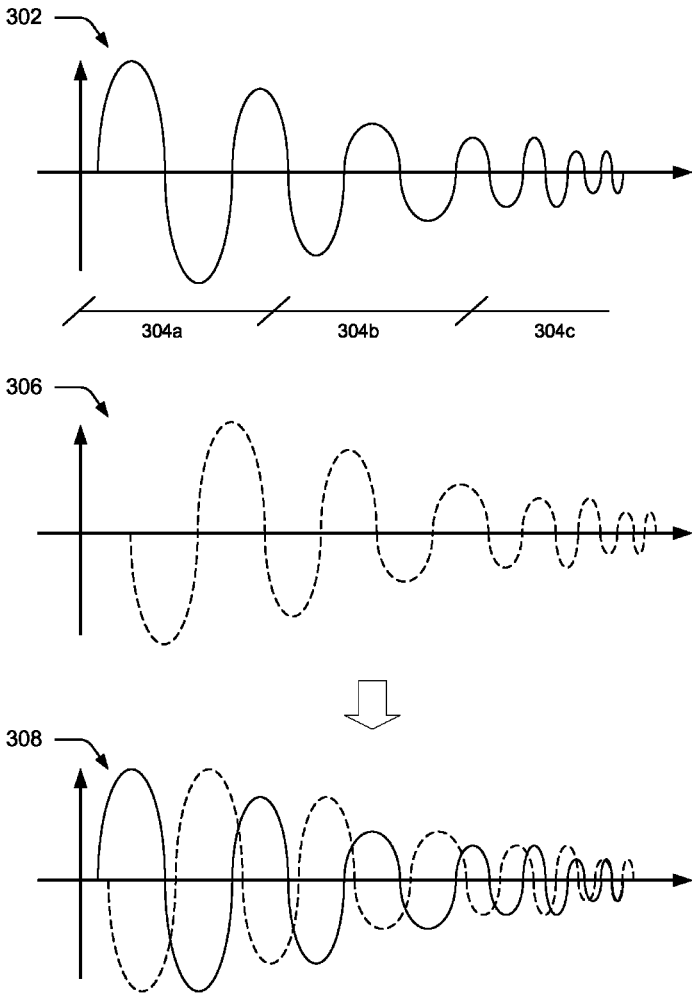
FIG. 3 is an illustration of signal diagrams in accordance with one or more embodiments.

To further illustrate, consider FIG. 3, which contains example audio signals in accordance with one or more embodiments. Conceptually, signal 302 represents a portion of a captured audio input signal, such as an audio input signal generated from acoustic waves 206 described in FIG. 2. While signal 302 is illustrated with a definitive shape, it is to be appreciated and understood that this is merely for illustrative purposes, and that audio signal can be any suitable type of signal varying in frequency and/or amplitude content. As discussed above, some embodiments analyze signal 302 effective to identify one or more properties. Signal 302 can be analyzed continuously, instantaneously, and/or over smaller portions of signal 302. For instance, signal 302 can be repeatedly captured over a set period of time, and analyzed for properties over each capture.

Blocks 304*a*, 304*b*, and 304*c* represent a series of capture periods in which signal 302 is analyzed. In this example, block 304*a* is captured first in time, block 304*b* is captured second in time, block 304*c* is captured third in time, and so forth. In some embodiments, signal 302 is analyzed independently for each capture block. When analyzing signal 302 over the different blocks, it can be observed that the signal varies in amplitude and frequency in each capture. Thus, as signal 302 changes over time, so would the determined properties for each capture block. While FIG. 3 illustrates a signal that varies between captures, it is to be appreciated that captures can contain a signal with constant amplitude and/or frequency without departing from the scope of the claimed subject matter. Properties of signal 302 are first calculated relative to block 304*a*, then for block 304*b*, 304*c*, and so forth. These properties can then be used to generate a counter signal, as further described above and below. Here, blocks 304*a-c* are illustrated as arbitrary blocks of time, and are used to represent any suitable amount of time, such capture times measured in microseconds, milliseconds, nanoseconds, and so forth. Each time block can be uniform in time with one another (e.g. a same amount of set time), or vary in duration of time between one another without departing from the scope of the claimed subject matter.

Once properties of signal 302 have been identified, some embodiments generate counter signal 306. In this example, counter signal 306 is illustrated as a time delayed version of signal 302 with its amplitude inverted. Here, the amplitude inversion is used to represent an inverse signal of signal 302. However, it is to be appreciated and understood that, while conceptually illustrated as an amplitude inversion of signal 302 over time, counter signal 306 can be any suitable type of inverse signal without departing from the scope of the claimed subject matter. In some embodiments, the delay in counter signal 306 represents an amount of time that corresponds to capturing at least part of signal 302, processing the captured part of signal 302 effective to identifying properties, and generating counter signal 306. Thus, some embodiments base the size of a capture block on this delay effective to generate counter signal 306 in real-time (e.g. at virtually a same time as signal 302, a point in time when a listener is less likely to hear a delay in the resultant signal, and/or a point in time when a listener is unable to discern a delay). For example, a smaller capture block corresponds to a smaller delay in time which, in turn, causes counter signal 306 to be generated and/or radiated at a point in time closer to its counterpoint in signal 302.

Once counter signal 306 has been generated, it can be radiated outward toward listeners in the surrounding environment and/or unintended listeners of signal 302. Here, signal 308 represents the combining of signal 302 with counter signal 306. Referring to the above discussion of FIG. 2, if signal 302 represented a captured version of acoustic waves 206, and counter signal 306 represented a signal used to generate acoustic waves 210, signal 308, in turn, would represent resultant acoustic waves 212. As can be seen conceptually, in summing the two signals together, counter signal 306 gives an opposite and/or inverse weighting to signal 302 at most points in time, thus canceling, reducing, and/or muting signal 302. Accordingly, some embodiments analyze an audio input signal (such as through digital signal processing and/or or analog circuits) effective to generate an inverse signal that can cause a phase shift and/or invert an associated polarity of the audio input signal. The inverse signal can be amplified and/or radiated outward from a device effective to create a sound wave directly proportional to the amplitude of the audio input signal (and subsequently creating destructive interference to cancel and/or muffle the audio input signal).

In some embodiments, a counter signal can be based upon word content of an audio input signal. For example, some embodiments generate a counter signal containing a language translation of the word content. Consider FIG. 4, which illustrates an example environment 400 that contains device 402. Similar to that discussed above for FIG. 2, device 402 is illustrated as a headset configured to send and receive audio as a way to communicate with other computing devices in accordance with one or more embodiments. Here, a user speaks into an associated microphone to communicate. As part of the communication, the user generates acoustic waves 404, which have an associated word content of "Hello my friend" in the English language. In some embodiments, device 402 analyzes an associated audio input signal to determine the word content, and generates a counter signal that contains a language translation of the identified word content. The counter signal is then radiated outward towards unintended listeners of acoustic waves 404. Here, the counter signal is illustrated as acoustic waves 406, which contain word content associated with an Italian translation of acoustic waves 404. Thus, a counter signal can contain any suitable type of masking, canceling, and/or tonal signal.

Figure 5:
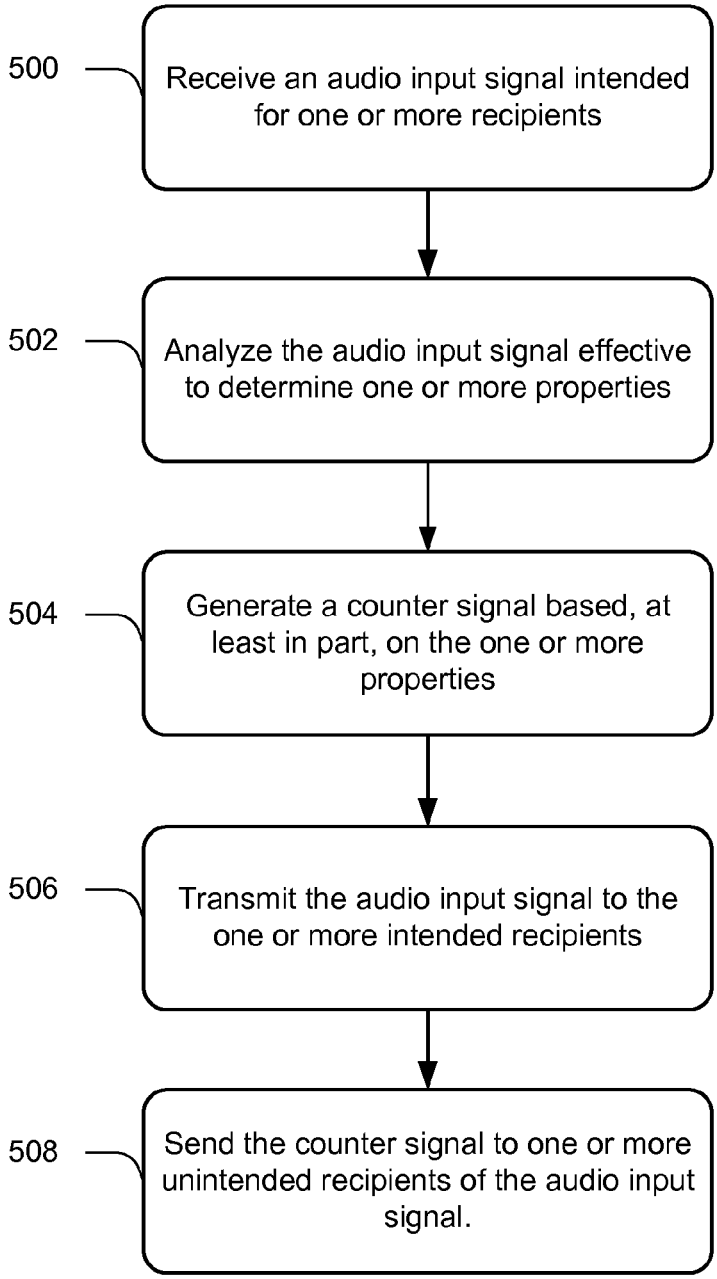
FIG. 5 is a flow diagram in accordance with one or more embodiments.

FIG. 5 is a flow diagram that describes steps in a method in accordance with one or more embodiments. The method can be implemented in connection with any suitable hardware, software, firmware, or combination thereof. In at least some embodiments, the method can be implemented by a suitably-configured system such as one that includes, among other components, audio input analysis module 108 and/or audio output generation module 110 as discussed above with reference to FIG. 1.

Step 500 receives an audio input signal intended for one or more recipients. The audio input signal can be generated (and received) in any suitable manner, such as an electronic signal generated by a microphone receiving acoustic waves. Alternately or additionally, the audio input signal can be received as a continuous waveform, a sampled version of a continuous waveform, and so forth. At times, the audio input signal can be part of a communication link that exchanges audio signals, such as a landline telephone conversation, a VoIP communication exchange, a wireless telecommunication exchange, and so forth. In some embodiments, the audio input signal can be associated with software applications, such as dictation software, voice-to-text software applications, and so forth. Thus, an intended recipient can be any suitable type of user and/or application to which the audio input signal is directed towards (e.g. another user engaged in the telecommunication exchange, multiple users participating in a conference call, a word processing application to which the dictation is inserted, and so forth). Conversely, an unintended recipient can be a type of user and/or application to which the audio input signal is not directed towards, such as a user in a surrounding environment that is not a participant in the communication link or a wayward microphone in the surrounding environment.

Responsive to receiving the audio input signal, step 502 analyzes the audio input signal effective to determine one or more properties associated with the audio input signal. Any suitable type of property can be determined, such as frequency content, amplitude-versus-time, word content, and so forth. In some embodiments, the audio input signal can be analyzed in multiple capture blocks. The blocks of time can be uniform (e.g. the same size) or can vary in size between one another. In other embodiments, the audio input signal can be analyzed as a continuous waveform, such as through the use of various hardware configurations.

Step 504 generates a counter signal based, at least in part, on the property or properties. In some cases, the counter signal is an audio signal designed to be the inverse of the audio input signal and/or designed to dampen and/or cancel out acoustic waves associated with the audio input signal. Alternately or additionally, the counter signal can include masking audio signals, such as interfering noise, a linguistic translation, and so forth. Some embodiments generate a counter signal that includes acoustic alert(s) and/or tone(s) configured to notify surrounding users that an audio cancellation event is in process.

Step 506 transmits the audio input signal to the one or more intended recipients. For example, the audio input signal can be transmitted to another user and/or participant engaged in the communication link.

Step 508 sends the counter signal outwardly effective to modify audible acoustic effects associated with the audio input signal. In some cases, the counter signal is directed towards one or more unintended recipients of the audio input signal, such as users and/or microphones in close proximity that are not engaged in the communication link. In some cases, the counter signal is radiated outwards from a device that has captured the audio input signal. This can be achieved in any suitable manner, such as through the use of a speaker facing outward and/or away from the user generating the audio input signal, and towards the unintended recipients. As discussed above, the counter signal can be a combination of any suitable types of signals, such as a tone combined with an inverse signal, and so forth.

Thus, a user can preserve their privacy in a conversation by generating a counter signal designed to silence and/or dampen audio tones associated with the conversation. Having considered a discussion of privacy preservation in a shared environment, consider now an example system and/or device that can be utilized to implement the embodiments described above.

Example System and Device

Figure 4:
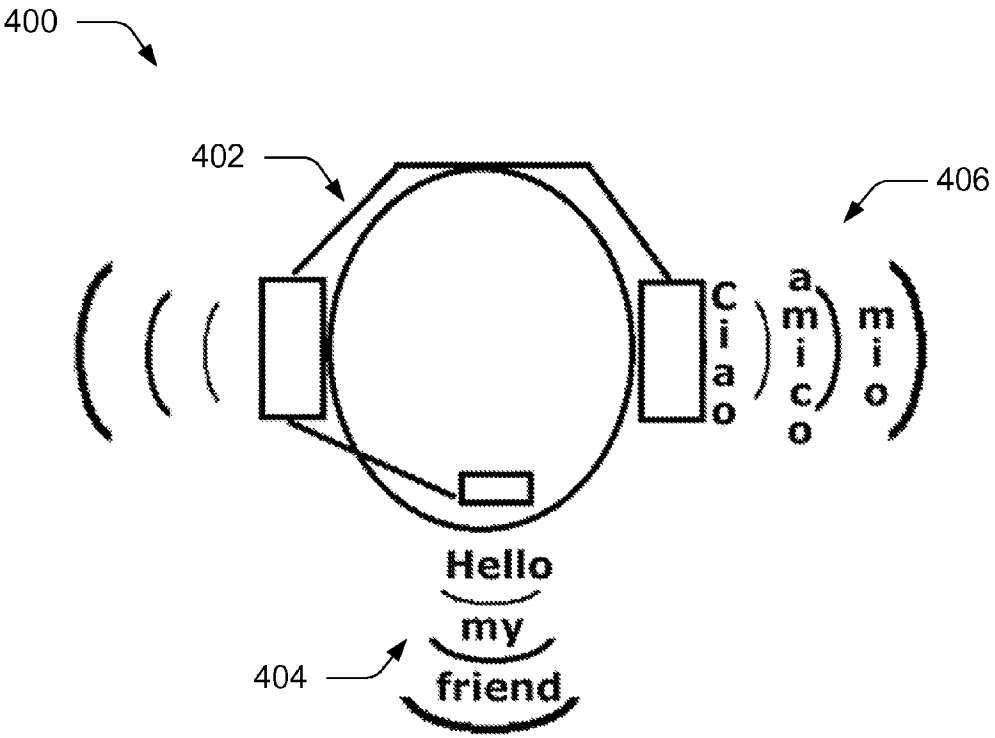
FIG. 4 is an illustration of an environment with an example implementation in accordance with one or more embodiments.
Figure 6:
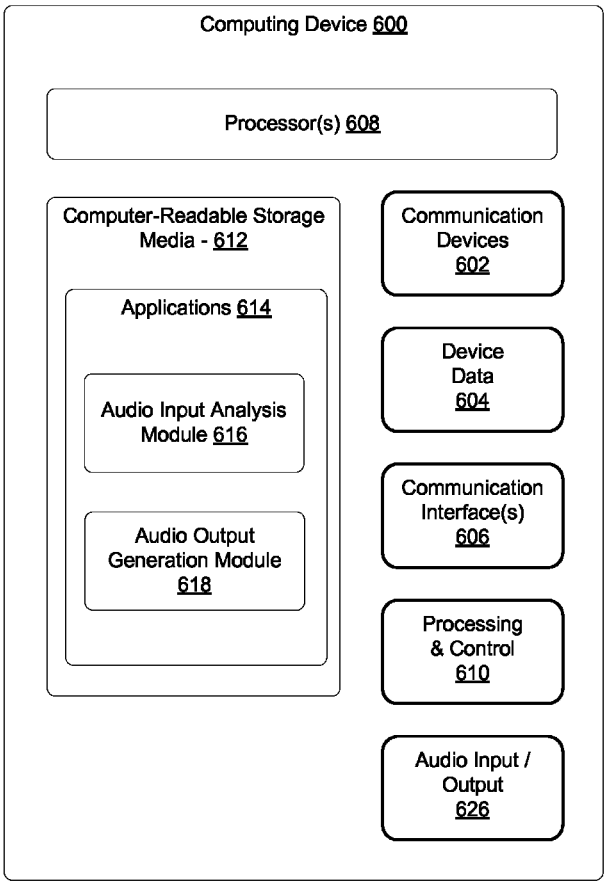
FIG. 6 is an example computing device that can be utilized to implement various embodiments described herein.

FIG. 6 illustrates various components of an example device 600 that can be implemented as any type of computing device as described with reference to FIGS. 1, 2, and 4 to implement embodiments of the techniques described herein. Device 600 includes communication devices 602 that enable wired and/or wireless communication of device data 604 (e.g., received data, data that is being received, data scheduled for broadcast, data packets of the data, etc.). The device data 604 or other device content can include configuration settings of the device and/or information associated with a user of the device.

Device 600 also includes communication interfaces 606 that can be implemented as any one or more of a serial and/or parallel interface, a wireless interface, any type of network interface, a modem, and as any other type of communication interface. In some embodiments, communication interfaces 606 provide a connection and/or communication links between device 600 and a communication network by which other electronic, computing, and communication devices communicate data with device 600. Alternately or additionally, communication interfaces 606 provide a wired connection by which information can be exchanged.

Device 600 includes one or more processors 608 (e.g., any of microprocessors, controllers, and the like) which process various computer-executable instructions to control the operation of device 600 and to implement embodiments of the techniques described herein. Alternatively or in addition, device 600 can be implemented with any one or combination of hardware, firmware, or fixed logic circuitry that is implemented in connection with processing and control circuits which are generally identified at 610. Although not shown, device 600 can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

Device 600 also includes computer-readable media 612, such as one or more memory components, examples of which include random access memory (RAM), non-volatile memory (e.g., any one or more of a read-only memory (ROM), flash memory, EPROM, EEPROM, etc.), and a disk storage device. A disk storage device may be implemented as any type of magnetic or optical storage device, such as a hard disk drive, a recordable and/or rewriteable compact disc (CD), any type of a digital versatile disc (DVD), and the like.

Computer-readable media 612 provides data storage mechanisms to store the device data 604, as well as various applications 614 and any other types of information and/or data related to operational aspects of device 600. The applications 614 can include a device manager (e.g., a control application, software application, signal processing and control module, code that is native to a particular device, a hardware abstraction layer for a particular device, etc.). The applications 614 can also include any system components or modules to implement embodiments of the techniques described herein. In this example, the applications 614 include an audio input analysis module 816 and an audio output generation module 618 that are shown as software modules and/or computer applications. Audio input analysis module 616 is representative of functionality associated with analyzing audio input signals effective to identify properties associated with the audio input signals, as further described above. Audio output generation module 618 is representative of functionality associated with generating one or more counter signals based, at least in part, on the properties identified by audio input analysis module 616. Alternatively or in addition, audio input analysis module 616 and/or audio output generation module 618 can be implemented as hardware, software, firmware, or any combination thereof.

Device 600 also includes an audio input-output system 626 that provides audio data. Among other things, audio-input-output system 626 can include any devices that process, display, and/or otherwise render audio. In some cases audio system 626 can include one or more microphones to generate audio from input acoustic waves, as well as one or more speakers, as further discussed above. In some embodiments, the audio system 626 is implemented as external components to device 600. Alternatively, the audio system 626 is implemented as integrated components of example device 600.

CONCLUSION

Various embodiments provide an ability to analyze an audio input signal and generate a counter audio signal based, at least in part, on the audio input signal. In some cases, combining the audio input signal with the counter audio signal renders the audio input signal incoherent and/or unintelligible to accidental listeners and/or listeners to whom the audio input signal is not directed towards. Alternately or additionally, the counter signal can mask the audio input signal to the accidental listeners.

Although the embodiments have been described in language specific to structural features and/or methodological acts, it is to be understood that the various embodiments defined in the appended claims are not necessarily limited to the specific features or acts described. Rather, the specific features and acts are disclosed as example forms of implementing the various embodiments.

What is claimed is:

1. A computer-implemented method comprising:

receiving, with a device, an audio input signal intended for one or more recipients;

analyzing, using the device, the audio input signal over a series of capture blocks effective to determine one or more properties associated with the audio input signal;

generating, using the device, a counter signal based, at least in part, on the one or more properties associated with the audio input signal; and sending, using the device, the counter signal outwardly from the device effective to modify audible acoustic effects proximate to the device and associated with the audio input signal, a size of each capture block based on a delay of the counter signal, the delay of the counter signal comprising an amount of time to capture at least part of the audio input signal corresponding to the respective capture block, analyze the captured part of the audio input signal to determine one or more properties, and generate the counter signal for the respective capture block.

2. The computer-implemented method of claim 1, wherein the counter signal comprises an inverse signal configured to reduce or cancel out the audible acoustic effects associated with the audio input signal.

3. The computer-implemented method of claim 1, wherein the counter signal comprises a linguistic translation of the audio input signal.

4. The computer-implemented method of claim 1, wherein sending the counter signal comprises radiating the counter signal using a speaker.

5. The computer-implemented method of claim 1 further comprising transmitting the audio input signal to the one or more intended recipients.

6. The computer-implemented method of claim 5, wherein the one or more intended recipients are one or more participants in a communication link.

7. The computer-implemented method of claim 1, wherein the counter signal comprises a language translation of word content of the audio input signal.

8. A system comprising:

at least one processor;

multiple audio speakers operably coupled to the at least one processor;

at least one microphone operably coupled to the at least one processor;

one or more computer-readable storage memories operably coupled to the at least one processor;

processor-executable instructions embodied on the one or more computer-readable storage memories which, responsive to execution by the at least one processor, are configured to:

receive an audio input signal intended for one or more recipients via the at least one microphone;

analyze the audio input signal over a series of capture blocks effective to determine one or more properties associated with the audio input signal;

generate a counter signal based, at least in part, on the one or more properties associated with the audio input signal; and radiate the counter signal outwardly from the system, using at least a first speaker of the multiple speakers, effective to modify audible acoustic effects proximate to the system and associated with the audio input signal, a size of each capture block based on a delay of the counter signal, the delay of the counter signal comprising an amount of time to capture at least part of the audio input signal corresponding to the respective capture block, analyze the captured part of the audio input signal to determine one or more properties, and generate the counter signal for the respective capture block.

9. The system of claim 8, wherein the system comprises a headset.

10. The system of claim 8, wherein the counter signal comprises an inverse signal configured to reduce or cancel out the audible acoustic effects associated with the audio input signal.

11. The system of claim 8, wherein the counter signal comprises an acoustic alert.

12. The system of claim 8 further configured to transmit the audio input signal to the one or more intended recipients.

13. The system of claim 12, wherein the one or more intended recipients are participants in a communication link associated with the system.

14. The system of claim 13, wherein the communication link comprises a Voice-over-Internet Protocol (VoIP) link.

15. The system of claim 13 further configured to:

receive a second audio input signal over the communication link from the one or more intended recipients; and radiate the second audio input signal using at least a second audio speaker of the multiple audio speakers.

16. The system of claim 8, wherein the one or more properties comprises word content.

17. The system of claim 8, wherein the counter signal comprises a language translation of word content of the audio input signal.

18. One or more computer-readable storage memories embodying one or more processor-executable instructions which, responsive to execution by at least one processor, are configured to implement:

an audio input analysis module configured to:

receive an audio input signal intended for one or more recipients; and analyze the audio input over a series of capture blocks effective to determine one or more properties associated with the audio input signal; and an audio output generation module configured to:

generate a counter signal based, at least in part, on the one or more properties associated with the audio input signal;

send the counter signal outward from a device associated with the at least one processor effective to modify audible acoustic effects proximate to the device and associated with the audio input signal, a size of each capture block based on a delay of the counter signal, the delay of the counter signal comprising an amount of time to capture at least part of the audio input signal corresponding to the respective capture block, analyze the captured part of the audio input signal to determine one or more properties, and generate the counter signal for the respective capture block.

19. The one or more computer-readable storage memories of claim 18, wherein the audio output generation module is further configured to:

generate an acoustic alert comprising at least one tone;

combine the acoustic alert with the counter signal; and send the combined acoustic alert and counter signal outward from the device.

20. The one or more computer-readable storage memories of claim 19, wherein the processor-executable instructions are further configured to selectively enable and disable generating and combining the acoustic alert with the counter signal.

* * * * *